US005314125A

United States Patent [19]

Ohno

[11] Patent Number: 5,314,125

[45] Date of Patent: May 24, 1994

[54] GRINDING METHOD AND APPARATUS

[76] Inventor: Ietatsu Ohno, 7-26, 3-chome, Nishi-Shinjuku, Shinjuku-ku, Tokyo, Japan

[21] Appl. No.: 757,561

[22] Filed: Sep. 11, 1991

[30] Foreign Application Priority Data

Sep. 21, 1990 [JP] Japan ..... 2-253570

[51] Int. Cl.[5] ..... B02C 17/14

[52] U.S. Cl. ..... 241/175; 51/164.2; 366/216; 494/33

[58] Field of Search ..... 241/30, 175, 180, 214; 51/164.1, 164.2; 366/216, 217; 494/33

[56] References Cited

U.S. PATENT DOCUMENTS 1,491,601 4/1924 Fuller ..... 241/175 X
2,937,814 3/1960 Joisel ..... 51/164.2
3,562,962 2/1971 Ohno ..... 51/164.2

*Primary Examiner*—Douglas D. Watts

*Attorney, Agent, or Firm*—Bauer & Schaffer

[57] ABSTRACT

A grinding method is provided which is capable of uniformly and precisely grinding objects for a short time, softening shocks produced when the rotation of a grinding barrel is changed between the forward direction and the backward direction to thereby eliminate bruises on the surface of grounded objects, coping with grinding for a large number of objects to be ground in a small quantity or a heavy-weight or a large-size object to be ground, and preventing contacts and collisions between objects to be ground. The grinding method comprises the steps of rotatably mounting not less than one grinding barrels at locations away from the central axis of a rotary drum, enclosing a grinding material and objects to be ground in the grinding barrels, rotating the grinding barrels in the directions identical to and opposite to the direction in which the rotary drum is rotated, and grinding the objects to be ground. An grinding apparatus for implementing the above-mentioned method is also provided.

13 Claims, 25 Drawing Sheets

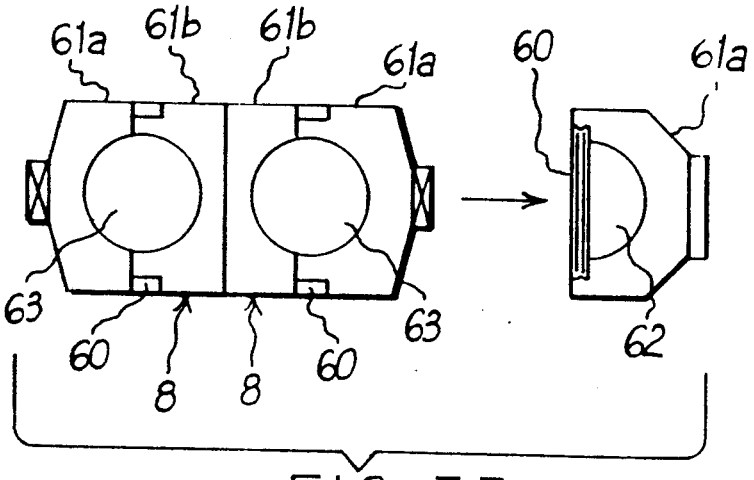
FIG 33
FIG 33a
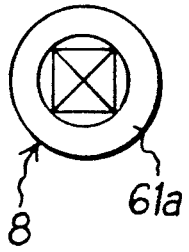
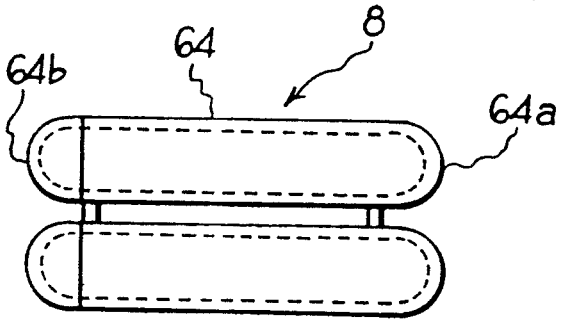
FIG 34
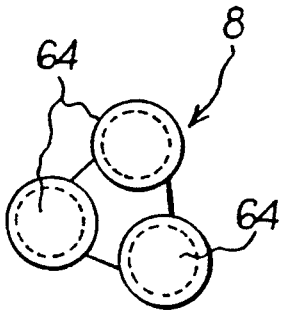
FIG 34a
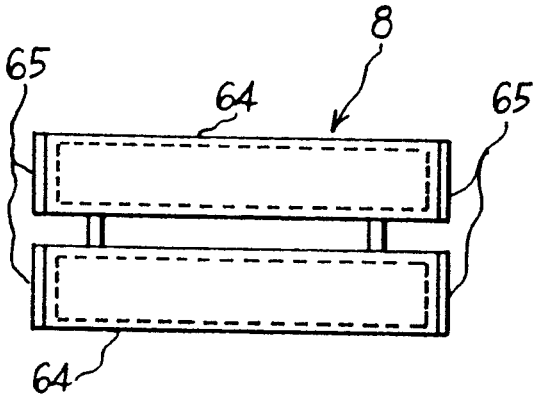
FIG 35
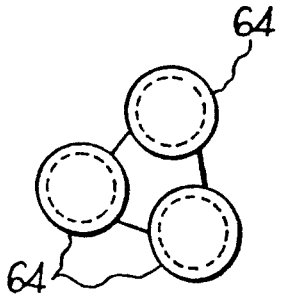
FIG 35a

GRINDING METHOD AND APPARATUS

BACKGROUND OF THE INVENTION

1. Field of the Invention

This invention relates to a grinding method and apparatus, and more particularly to a grinding method adapted to enclose objects to be ground and a grinding material in a grinding barrel and give the grinding barrel a variety of motions to grind the objects to be ground, and a grinding apparatus for implementing such a method.

2. Description of the Prior Art

A conventional grinding method adapted to enclose objects to be ground and a grinding material in a grinding barrel and give the grinding barrel a variety of motions, that is, a so-called barrel grinding method employs a grinding barrel which is axially supported by a carrier or a drum, where the center of the grinding barrel is positioned concentrically with the rotating shaft about which the grinding barrel is rotated. The grinding barrel is rotated by a driving unit or rotated in the same direction as a drum to produce a centrifugal force to thereby perform a grinding process. In either case, the grinding barrel is rotated with the center thereof as the rotating axis, whereby objects to be ground and a grinding material in the grinding barrel are subjected to a repetition of identical circular motions or fixed motions. For this reason, only an upper portion of a mass of the objects to be ground and the grinding material can be agitated by an avalanche phenomenon to grind the objects to be ground.

The above-mentioned grinding method, however, implies a number of problems such as a lack of uniformity in finished products, residue of the grinding materials in recesses, curved surfaces, rear surfaces and so on, bruises on the surfaces of ground objects, and so on. Furthermore, the grinding method as mentioned above is not capable of providing a sufficiently high quality of grinding even if the rotational speed of the grinding barrel is decreased to grind the objects for a long time.

Generally, the above-mentioned grinding barrel is constructed such that the diameter and the length thereof are chosen to be the same size. Such a construction may cause objects being ground to overlap each other, and accordingly a number of bruises are produced on the surface of ground objects. To solve this problem due to the construction of the grinding barrel, there have been proposed a grinding barrel having the diameter and the length different from each other and a method of rotating a grinding barrel in forward and backward directions.

However, in such alternate rotations of the grinding barrel in the forward and backward directions, gears and pulleys for rotating the grinding barrel may be damaged by shocks given to these elements when the rotation is changed from the forward direction to the backward direction and vice versa. For this reason, if the rotational speed of the grinding barrel is decreased, the grinding process takes a long time, thereby rendering it impossible to completely prevent bruises on the surfaces of ground objects.

Further, the above mentioned grinding barrel generally comprises a single chamber therein and one to four grinding barrels are mounted on a drum. The internal chamber of the barrel is appropriately re-shaped in accordance with the necessity for providing an optimal grinding for objects to be ground.

The conventional grinding barrel as mentioned above, however, comprises a single internal chamber and the volume thereof is definite, so that it is difficult to grind a large number of different objects in a small quantity or precisely grind a heavy-weight or a large-volume object in such a barrel. In addition, a troublesome time-consuming exchange is necessary every time a different grinding is to be performed. It is also difficult to precisely finish the surface of grounded objects due to bruises caused by collisions and contacts of objects being grounded.

OBJECTS AND SUMMARY OF THE INVENTION

In view of the problems mentioned above, it is an object of the present invention to provide a grinding method which is capable of uniformly and precisely grinding objects to be grounded for a short time and a grinding apparatus for implementing this method.

It is another object of the present invention to provide a grinding method which is capable of softening shocks produced when the rotation of a grinding barrel is changed between the forward direction and the backward direction to thereby eliminate bruises on the surface of grounded objects and a grinding apparatus for implementing this method.

It is a further object of the present invention to provide a grinding method which is capable of coping with grinding for a large number of objects to be ground in a small quantity or a heavy-weight or a large-size object to be ground, preventing contacts and collisions between objects to be ground, and enabling a precise grinding, and a grinding apparatus for implementing this method.

It is a yet further object of the present invention to provide a grinding method which permits an arbitrary selection of a material, e.g., hard or soft material for the inner construction of a grinding barrel in accordance with the characteristics of objects to be ground and purposes for grinding, and an grinding apparatus for implementing this method.

To achieve the above objects, according to one aspect of the present invention, there is provided a grinding method which comprises the steps of:

rotatably mounting not less than one grinding barrels at locations away from the central axis of a rotary drum;

enclosing a grinding material and objects to be ground in the grinding barrels;

rotating the grinding barrels in the directions identical to and opposite to the direction in which the rotary drum is rotated; and grinding the objects to be ground.

According to the second aspect of the invention, there is provided a grinding apparatus comprising:

a rotary drum adapted to be rotated by a driving unit;

a grinding barrel rotatably mounted at a location away from the central axis of the rotary drum; and a rotating direction changing mechanism for rotating the grinding barrels in the forward and backward directions, wherein a grinding material and objects to be ground are enclosed in the grinding barrel, the rotary drum is rotated, the grinding barrel is rotated in the directions identical to and opposite to the direction in which the rotary drum is rotated, and the objects are ground.

The above and other objects, features and advantages of the present invention will become apparent from a consideration of the following detailed description given with reference to the accompanying drawings, which specify and show preferred embodiments of the invention.

BRIEF DESCRIPTION OF THE DRAWINGS

FIGS. 23*a* and 23*b* are lateral views of grinding barrels;

FIG. 33 is a sectional view of a grinding barrel;

FIG. 33*a* is an end view of the grinding barrel seen in FIG. 33;

FIG. 34 is a sectional view of another grinding barrel;

FIG. 34*a* is an end view of the grinding barrel shown in FIG. 34;

FIG. 35 is a sectional view of another grinding barrel; and

FIG. 35*a* is an end view of the grinding barrel of FIG. 35*a*.

DESCRIPTION OF THE PREFERRED EMBODIMENTS

Preferred embodiments of the present invention will hereinbelow be described with reference to the accompanying drawings.

Figure 1:
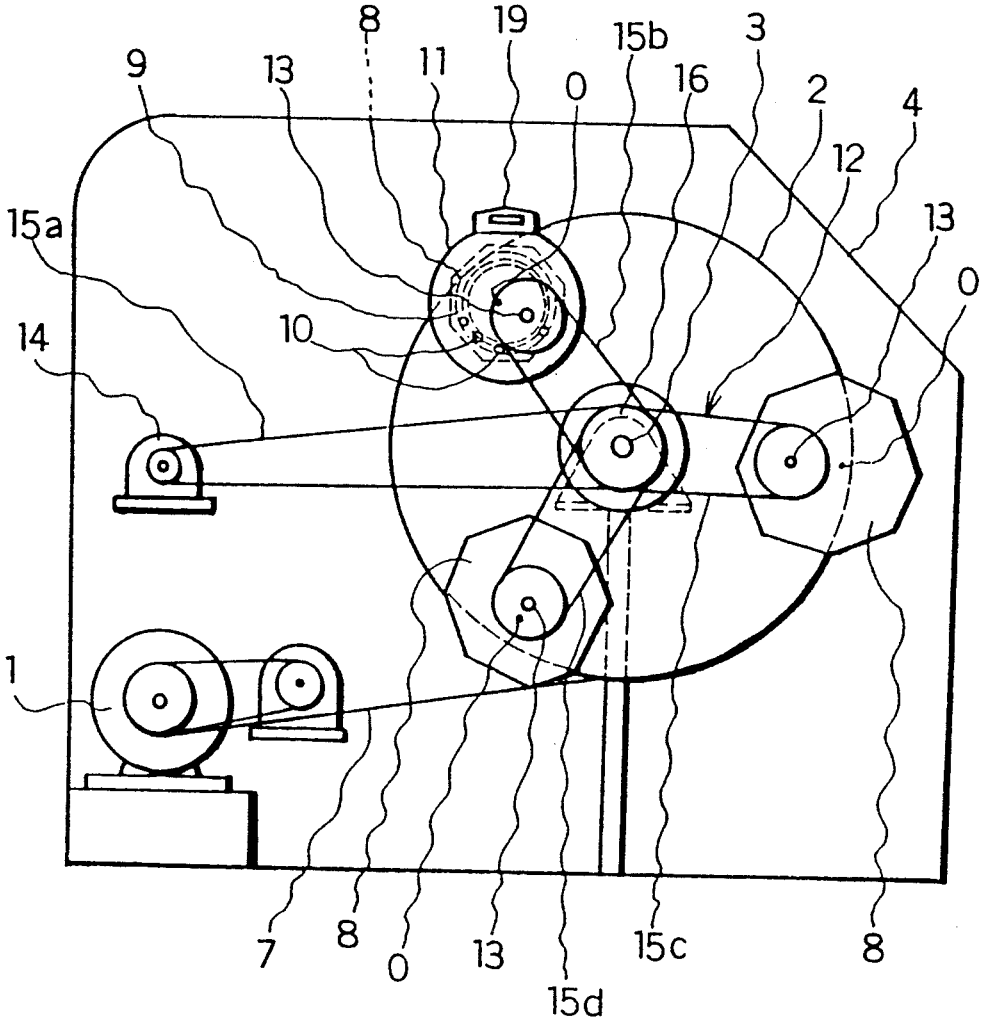
FIG. 1 is a lateral view illustrating the positional relationship between a rotary drum and grinding barrels according to the present invention.
Figure 2:
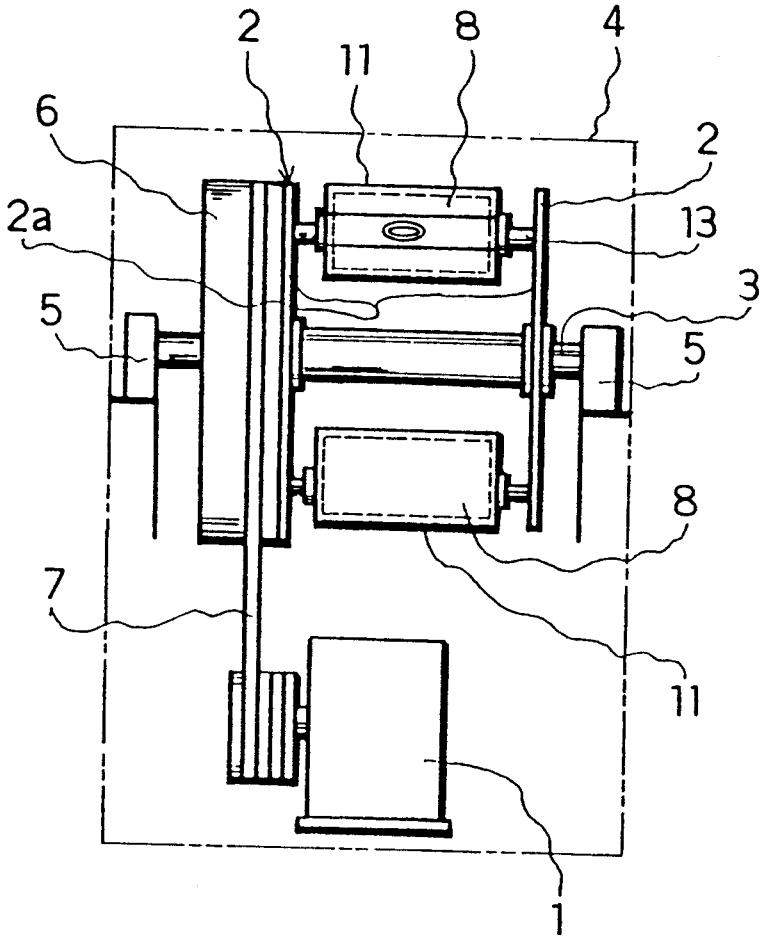
FIG. 2 is a plan view of the apparatus shown in FIG. 1.

In FIGS. 1 and 2, reference numeral 1 designates a driving unit for driving a grinding apparatus of the present invention.

A rotary drum 2, formed in a reel shape, has a central shaft 3 which is rotatably supported by main bearing 5 disposed on the inner surfaces of side walls of an apparatus body 4.

On one of turret drum plates 2*a*, there is integrally fixed a large pulley 6, such that the rotary drum 2 is rotated by the driving unit 1 through the large pulley 6 and a belt 7.

Reference numeral 8 designates a grinding barrel which is mounted on a grinding barrel mounting frame 11 after a grinding material 9 and objects to be ground are enclosed therein. A plurality of (three in the drawing) grinding barrels 8 are mounted between the turret drum plates 2*a* at locations close to the outer periphery of the rotary drum 2, such that they are rotated in the direction opposite to the rotating direction of the rotary drum 2 through a rotating direction changing mechanism 12, whereby the grinding material 9 and the objects to be ground are agitated in a complex manner which has never been seen, thereby making it possible to provide an extremely precise finishing.

Reference numeral 13 designates a rotating shaft which projects toward the outside of the both sides of the grinding barrel fixing frame 11. The grinding barrel fixing frame 11 is rotated with the rotating shaft 13 at the center.

Incidentally, the rotating direction changing mechanism 12 is principally composed of a motor 14, belts 15*a*, 15*b*, 15*c*, 15*d*, and a main pulley 16. Alternatively, such mechanism may be composed of chains, sprockets, gears and so on.

Figure 3A:
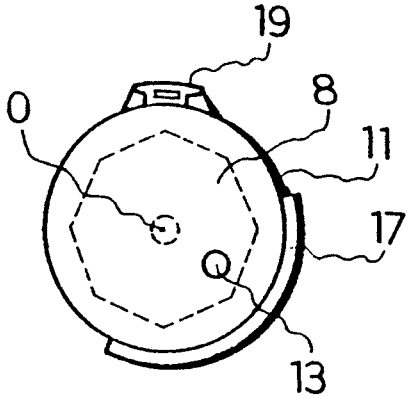
FIGS. 3*a* and 3*b* are front views of grinding barrel mounting frames which respectively have the rotating axis eccentrically deviated from the center.
Figure 3B:
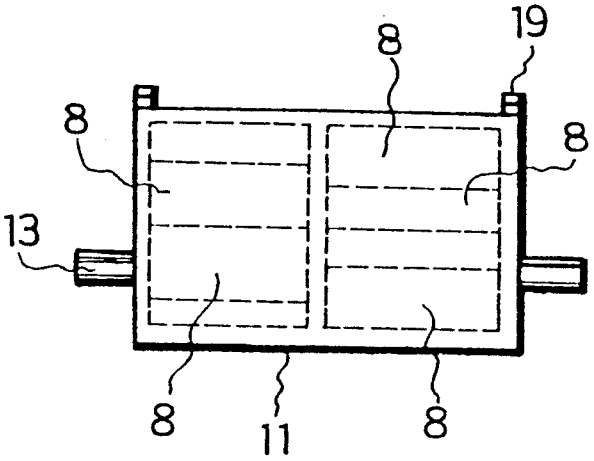
Figure 3C:
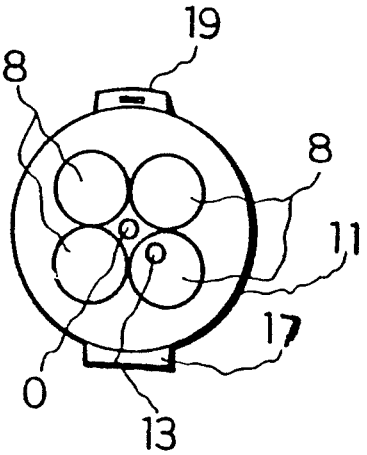
FIG. 3*c* is a lateral view of the grinding barrel mounting frame.
Figure 4:
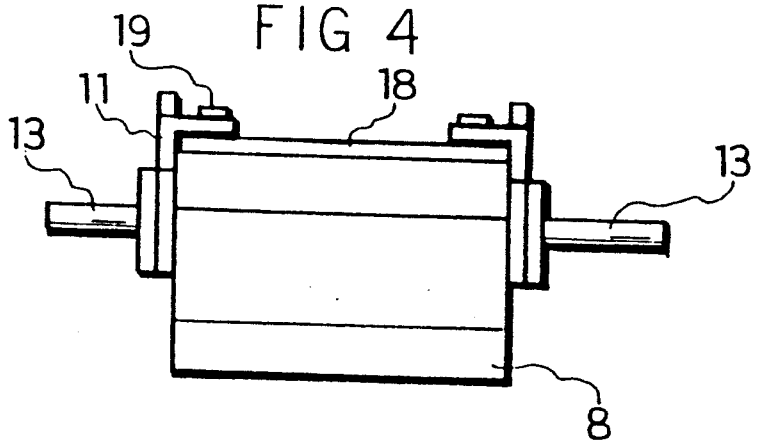
FIG. 4 is a lateral view of a grinding barrel having an eccentric rotating shaft.
Figure 5:
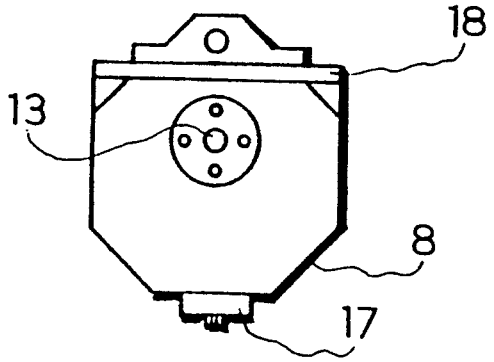
FIG. 5 is a front view of the grinding barrel shown in FIG. 4.
Figure 6:
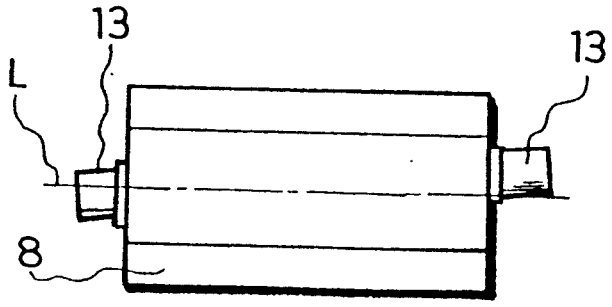
FIG. 6 is a lateral view of a grinding barrel having an obliquely deviated rotating shaft.
Figure 7:
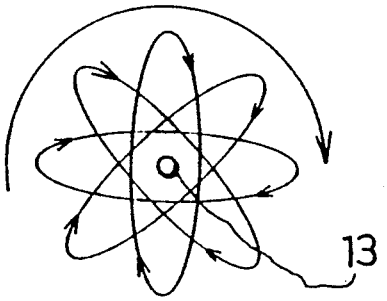
FIG. 7 is a diagram showing motions of a grinding material and objects to be ground in a grinding barrel in an operating state.
Figure 8:
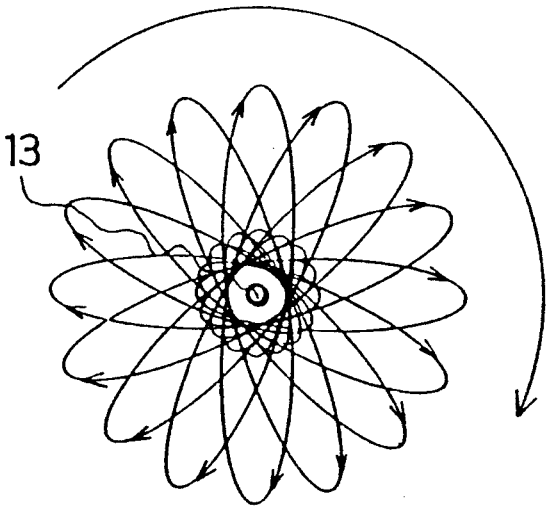
FIG. 8 is a diagram showing motions of a grinding material and objects to be ground in an eccentrically mounted grinding barrel.
Figure 9:
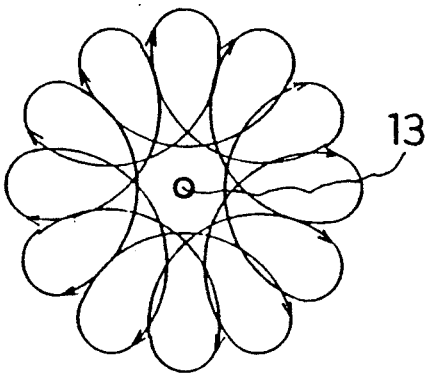
FIG. 9 is a diagram showing motions of a grinding material and objects to be ground in an obliquely mounted grinding barrel.

It is also possible to mount the grinding barrel 8 in a manner that the rotating shaft 13 of the grinding barrel mounting frame 11 is eccentrically deviated from the center O of the grinding barrel 8 as shown in FIGS. 3*a*, 3*b*, 3*c*. The rotating shaft 13 may be directly contacted to the grinding barrel 8 as shown in FIGS. 4, 5. Such changes in the position of the center O allow the grinding barrel to rotate in a complex manner which has never been seen as shown in FIG. 8. Further, when the grinding barrel 8 is mounted obliquely with respect to a central line L of the grinding barrel mounting frame 11 or the grinding barrel 8, further complex rotations may be provided as shown in FIG. 9, thereby producing a remarkable effect in a grazed finish and mirror polishing which require extremely fine grinding.

The grinding barrel 8 is provided with a balancing weight 17 for cancelling unbalance caused by the eccentric mounting of the grinding barrel 8 and the grinding material 9 and the objects 10 to be ground enclosed in the grinding barrel 8. This balancing weight 17 may be a flywheel mounted on the driving unit 1. Alternatively, a sufficiently heavy pulley, for example, the aforementioned large pulley 6 may be used as the balancing weight 17 in place of the flywheel.

Figure 10:
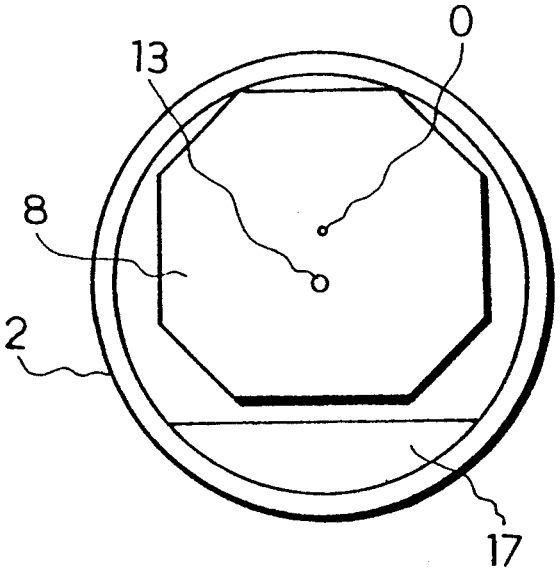
FIG. 10 is a cross-sectional view of a grinding barrel.

FIG. 10 illustrates a cross-section of the grinding barrel 8, where the center 0 is different from the center of the circulation of the grinding material 9 and the objects to be ground 10 in the barrel 8, and the above-mentioned complex movement is produced thereby.

Figure 11A:
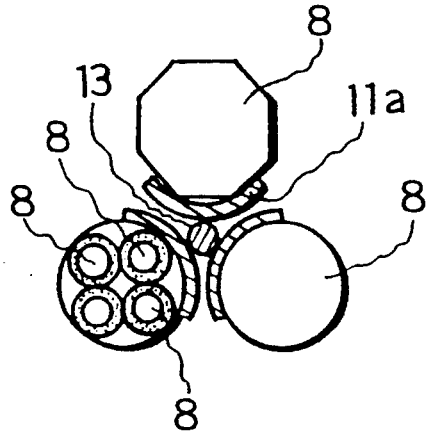
FIGS 11*a*, 11*b*, 11*c* are cross-sectional views respectively illustrating how grinding barrels are mounted on grinding barrel carriers.
Figure 11B:
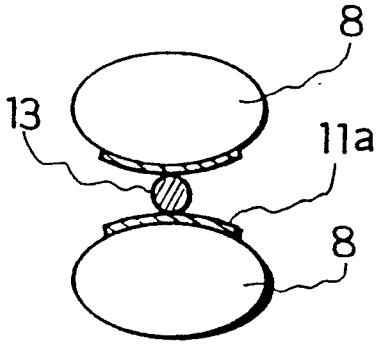
Figure 11C:
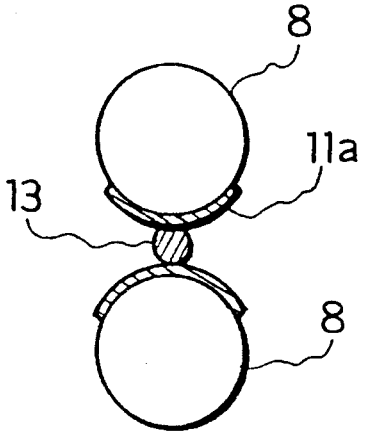

FIGS. 11*a*–11*c* illustrate that the grinding barrels 8 in a variety of shapes are mounted on grinding barrel carriers 11*a* which are integrated with the rotating shaft 13 of the grinding barrel mounting frame 11. Apart from the examples shown in FIGS. 11*a*–11*c*, many variations can be thought.

Incidentally, reference numeral 18 shown in FIG. 4 designates a lid of the grinding barrel 8, and 19 a fixture for mounting the grinding barrel 8 on the grinding barrel mounting frame 11.

Figure 12:
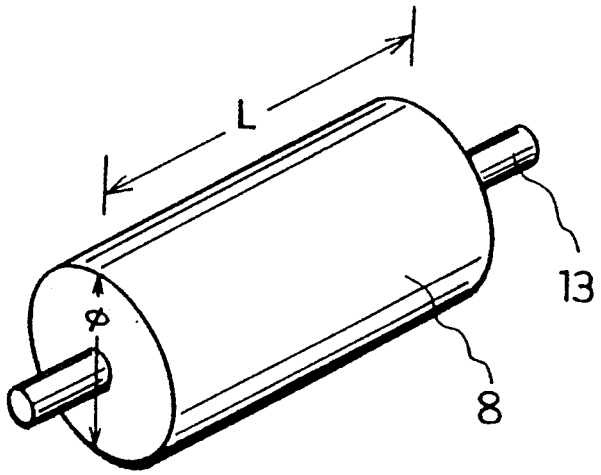
FIG. 12 is a perspective view of a grinding barrel having the length 1.3 times longer than the diameter.

FIG. 12 shows the relationship between the diameter ($\phi$) and the length (L) of the grinding barrel 8. When the shape of the grinding barrel 8 is selected to satisfy a condition expressed by $L \leqq 1.3 \times \phi$, objects to be ground will not overlap each other or collide with each other in the grinding barrel 8.

Figure 13:
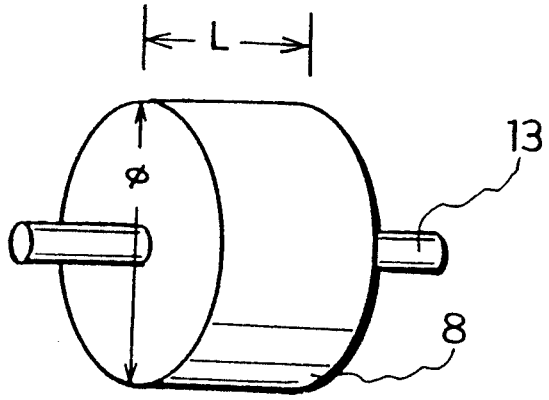
FIGS. 13 and 14 are perspective views respectively illustrating a grinding barrel having the length not more than 0.8 times as long as the diameter.
Figure 14:
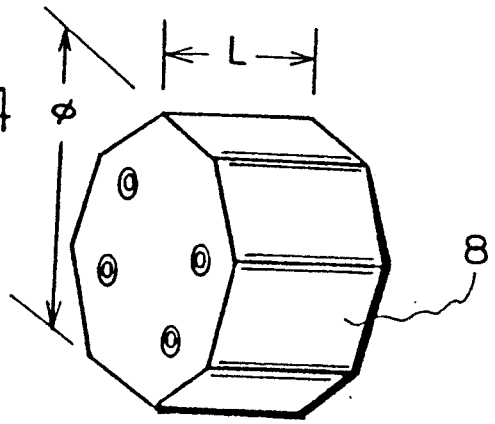

FIGS. 13, 14 illustrate other shapes of the grinding barrel 8 which satisfy a condition expressed by $L \geqq 1.3 \times \phi$. Since the grinding barrel is relatively deep, objects to be ground, even if existing in the vertical direction, will not overlap each other or collide with each other in the barrel.

Figure 15:
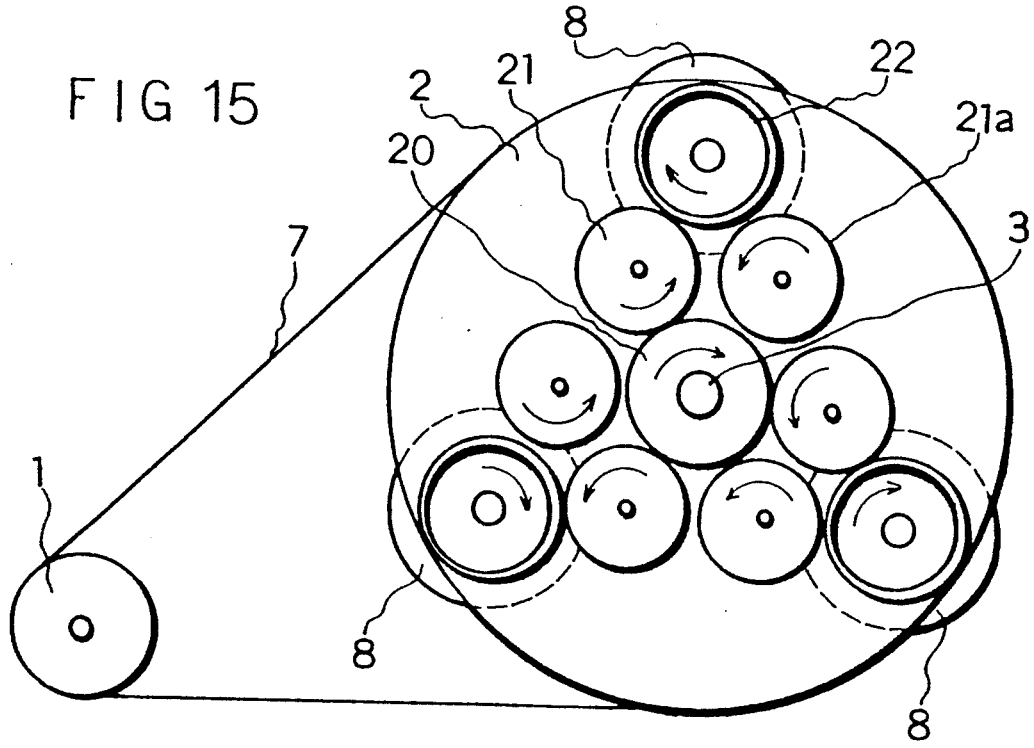
FIG. 15 is a diagram illustrating the inner structure of a grinding apparatus according to the present invention.
Figure 16:
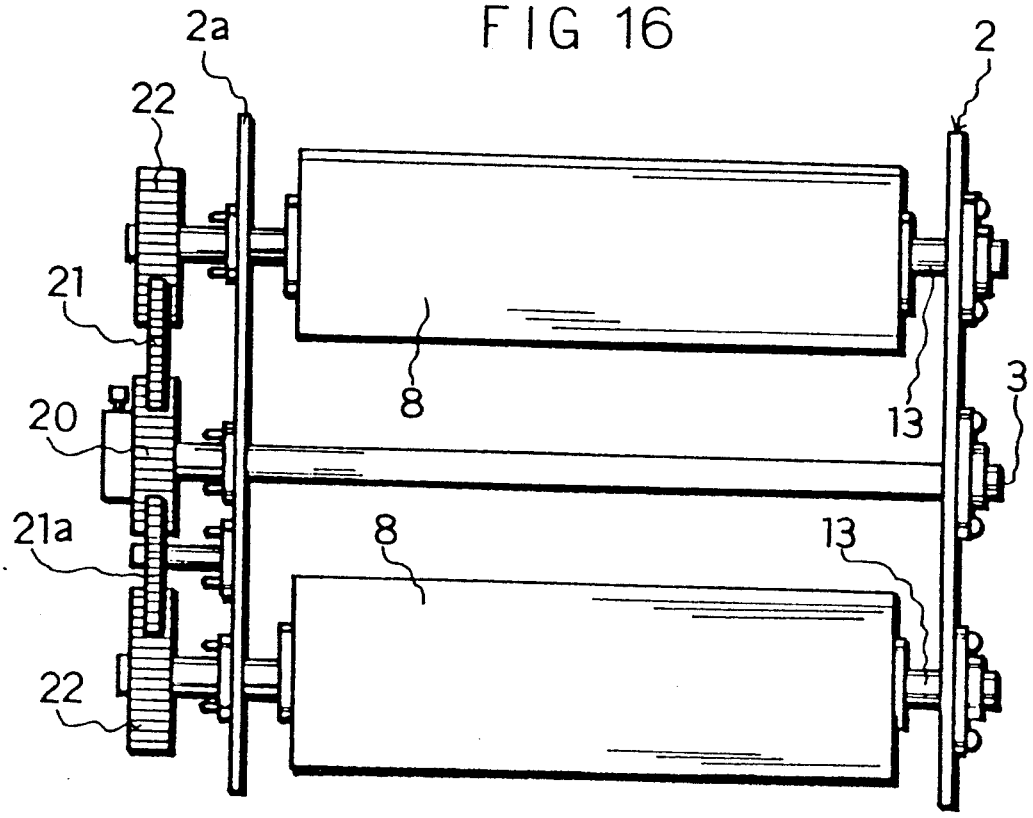
FIG. 16 is a front view of the inner structure of the grinding apparatus shown in FIG. 15.

FIGS. 15, 16, 17 illustrate the driving relationship among the constituent elements when the grinding barrel 8 is rotated in the forward and backward direction. Both ends of the central shaft 3 are supported by the main bearings 5 as shown in FIG. 2 for fixing the rotary drum 2. A gear 20 (a rotating body on the driving side) is secured on the central shaft 3.

A rotation of the rotary drum 2, therefore, causes the grinding barrel 8 to rotate through intermediate gears (intermediate rotating bodies) 21, 21*a* and gears 22 (rotating bodies on the driven side). The rotary drum 2 and the grinding barrel 8 are adapted to be rotated by rotation, revolution, centrifugal force and so on, in the forward and backward directions by means of a known reversing means (not shown) provided therefor.

The above-mentioned intermediate gears 21, 21*a* are respectively disposed on the left and right sides of the gears 22 on the axial line of the gears 20 and 22 for transmitting the rotation of the gear 20 to the gears 22. Also, in the event of forward and backward rotations, either one of the intermediate gears 21, 21*a* engages the gears 20, 22 and the other one is made free.

Figure 17A:
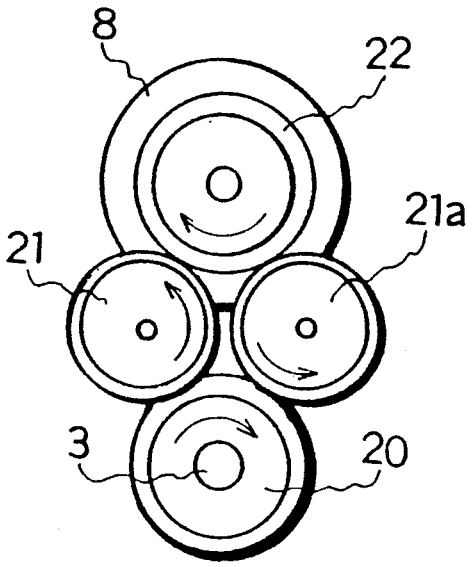
FIGS. 17(*a*), 17(*b*) show a gear drive.
Figure 17B:
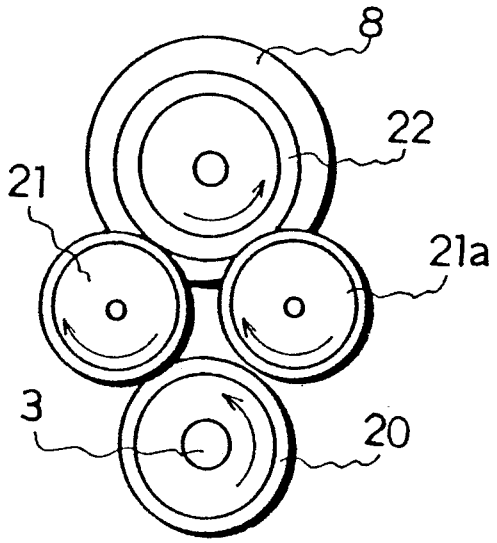

More specifically, when the gear 20 is rotated in the rightward direction, the gear 22 is also rotated in the same direction as shown in FIG. 17*a*, whereby the intermediate gear 21 engages with both gears 20, 22. On the contrary, when the gear 20 is rotated in the leftward direction (backward direction), the intermediate gears 21*a* engages with both gears 20, 22, as shown in FIG. 17*b*.

Thus, the associative actions are smoothly performed by the intermediate gears 21, 21*a*, and gears 20, 22, whereby the respective gears are prevented from being damaged or torn, in contrast with a conventional case where a single intermediate gear 21 is solely provided.

Figure 18:
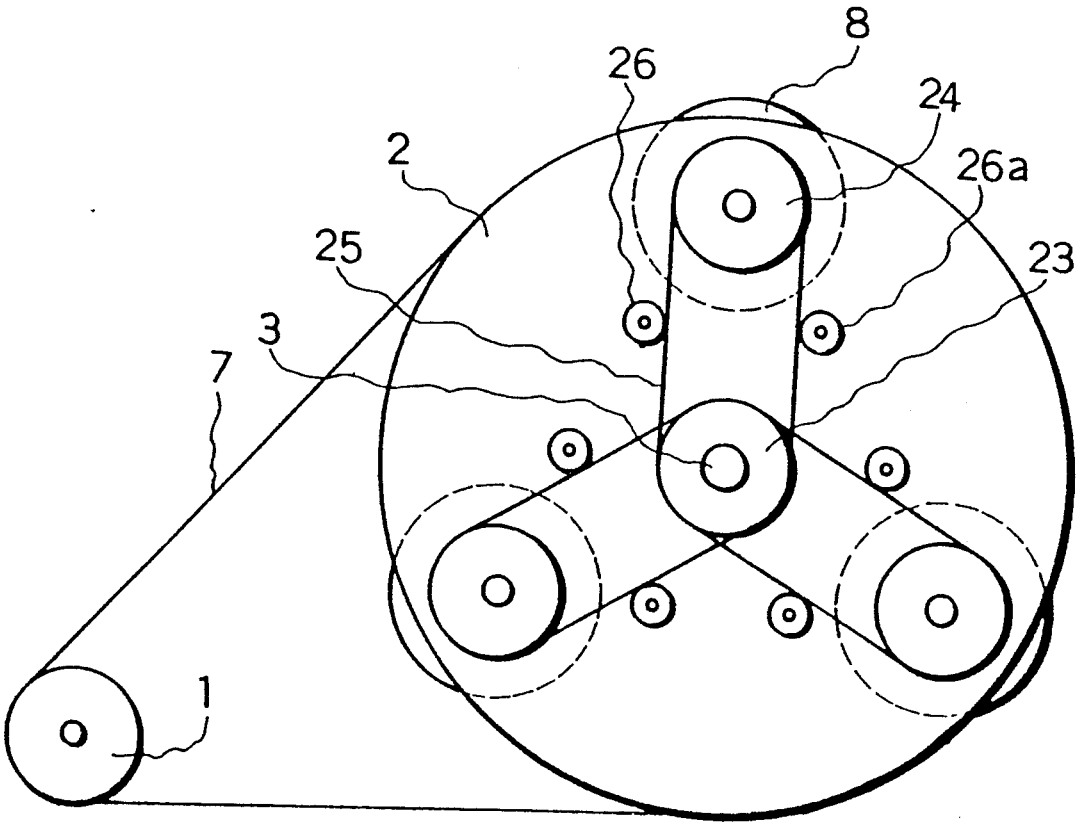
FIG. 18 shows an alternative drive for the device.

FIG. 18 shows a modification where the respective gears 20, 21, 21*a*, 22 are replaced with pulleys. It is also possible to couple a pulley 23 (a rotating body on the driving side) with a pulley 24 (a rotating body on the driven side) by means of a belt 25. If intermediate pulleys 26, 26*a* (intermediate rotating bodies) are arranged on both sides of the belt 25, switching of rotation in the forward and backward directions can be smoothly performed by an interaction of the intermediate pulleys 26, 26*a*, in a manner similar to the above-mentioned construction which employs gears.

Figure 19A:
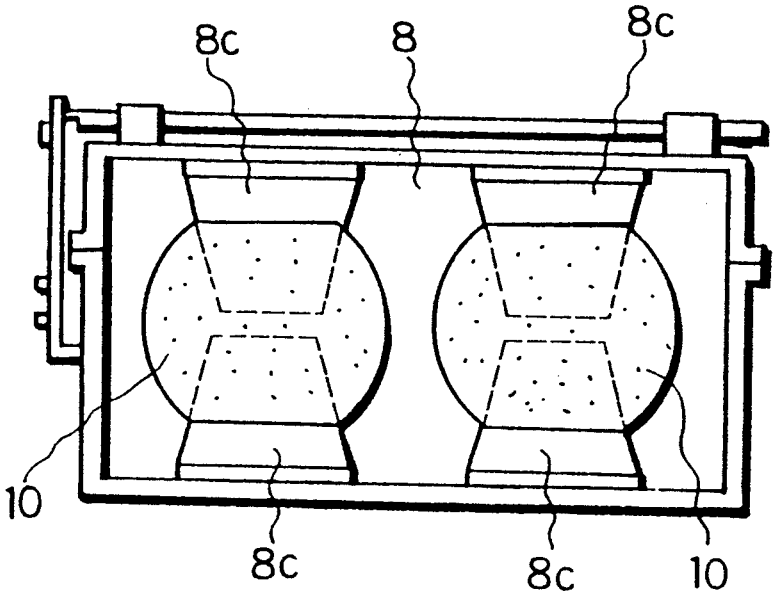
FIGS. 19(*a*), 19(*b*) show supports.
Figure 19:
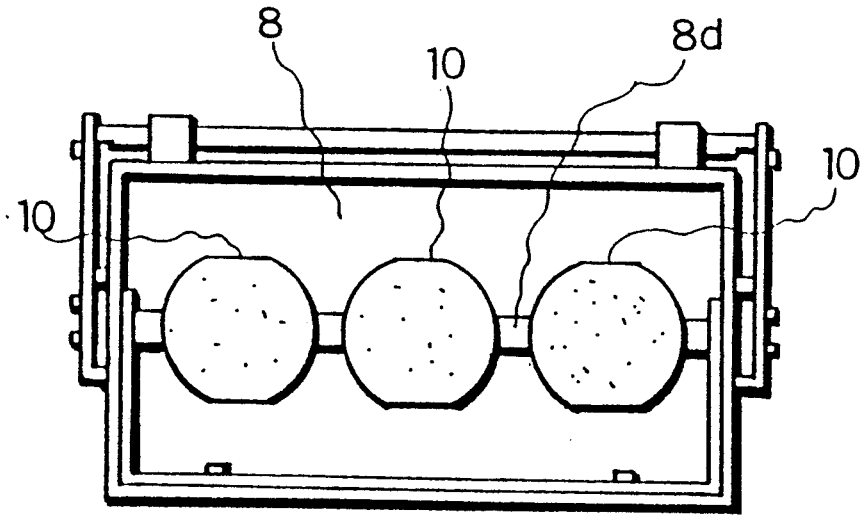

FIGS. 19*a*, 19*b* show that objects to be ground are supported by supporters 8*c* or mounted on a supporting shaft 8*d* in the grinding barrel 8, which enables a highly precise grinding in a relatively short time.

Figure 20A:
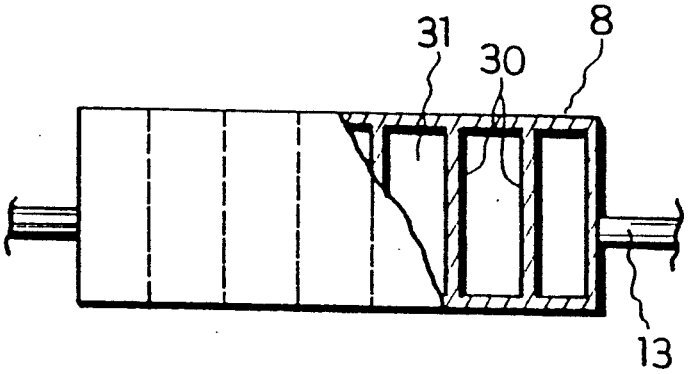
FIGS. 20(*a*), 20(*b*), 21(*a*), 21(*b*), 229*a*) and 22(*b*) are cross-sectional views of grinding barrels.
Figure 20B:
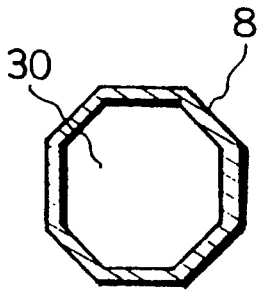
Figure 21A:
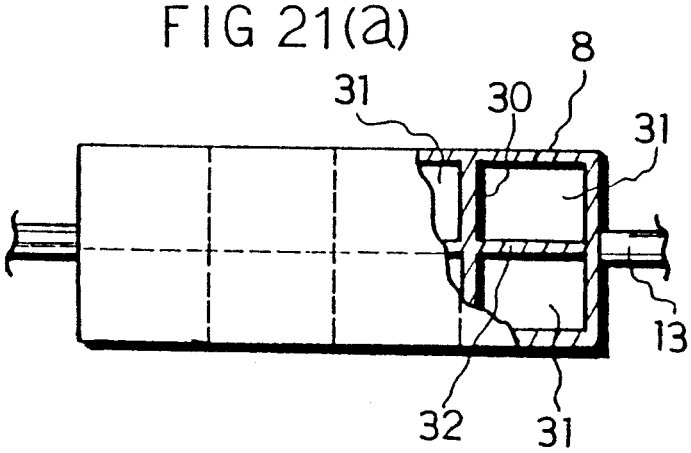
Figure 21B:
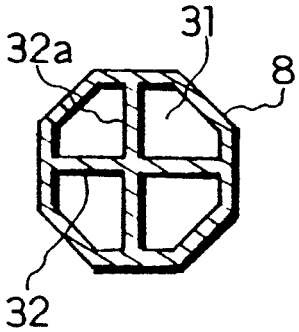
Figure 22A:
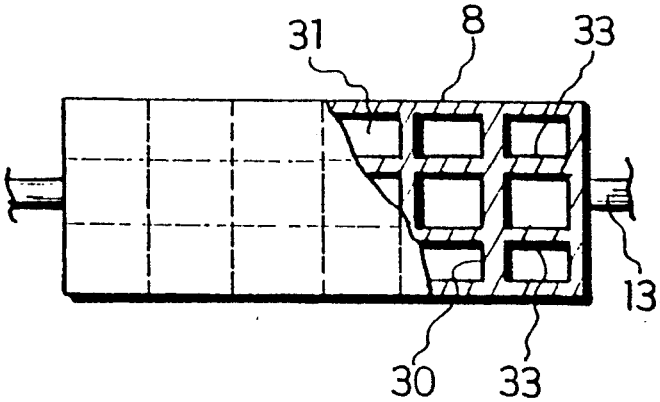
Figure 22B:
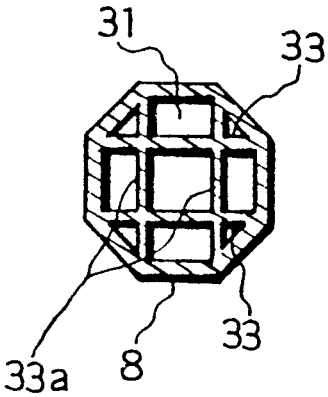

FIGS. 20*a*, 20*b* illustrates the grinding barrel 8 in another shape, that is, octagonal in cross-section. The internal chamber is divided into a plurality of sub chambers 31 by parallel partition walls 30 disposed perpendicular to the rotating shaft 13 of the grinding barrel 8. The respective sub-chambers 31 are provided with a lid, and a variety of different objects are accommodated separately in the respective sub-chambers 30 and ground. The partition walls 30 are not limited to be perpendicular to the rotating shaft 13, and alternatively may be disposed with a predetermined angle with respect to the rotating shaft 13.

The grinding barrel 8 may also be formed as shown in FIGS. 21*a*, 21*b*, 22*a*, 22*b*, where partition walls 32, 32*a*, 33, 33*a* are disposed in parallel with the rotating shaft 13 in addition to the partition walls 30 to further divide the respective sub-chambers 30 into smaller chambers. With these grinding barrels, it is possible to simultaneously grind a more number of different objects by a single grinding apparatus as well as facilitate the accesses to the ground objects.

Figure 23:
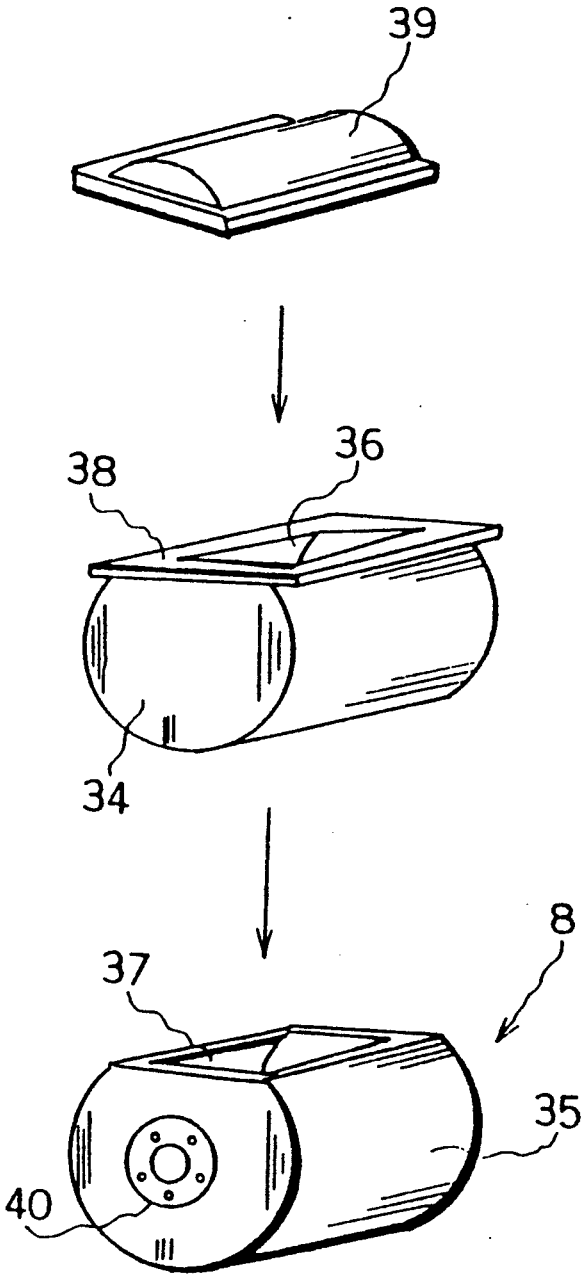
Figure 23A:
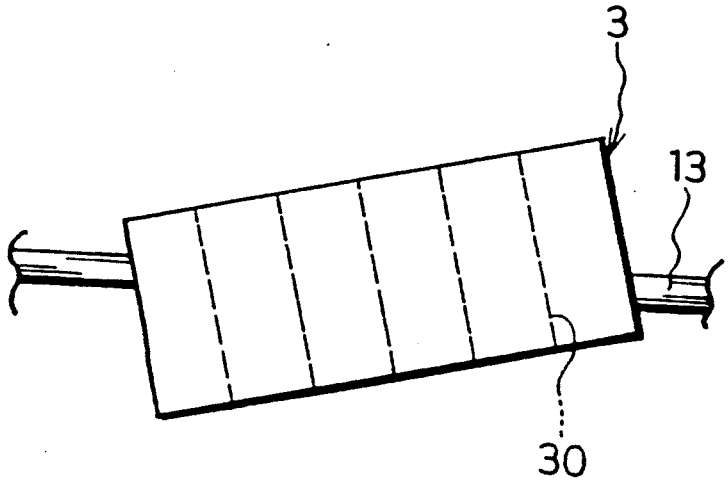
FIGS. 23A is a perspective view of a grinding barrel.
Figure 23B:
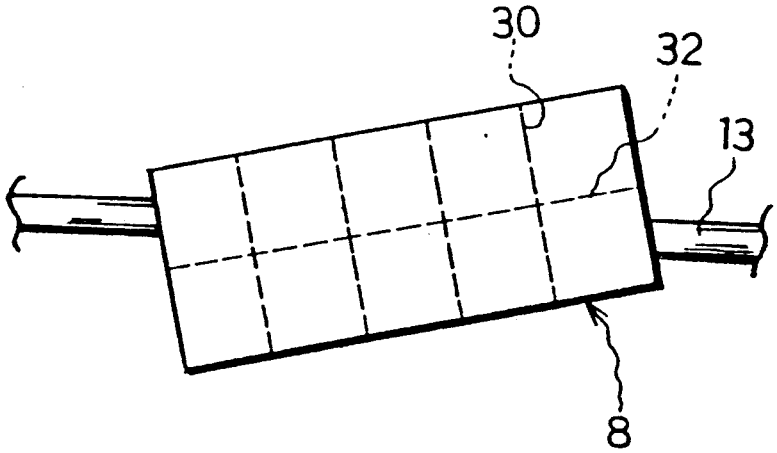

The grinding barrels 8 shown in FIGS. 20, 21, 22 may be mounted at a predetermined angle with respect to the rotating shaft 13 to improve the grinding efficiency, as shown in FIGS. 23*a*, 23*b*.

FIG. 23 shows that the grinding barrel 8 may be divided into sub-chambers by means of an inner barrel 34 without partition walls. In this embodiment, the grinding barrel 8 is composed of an outer barrel 35 and the inner barrel 34, both formed in a substantially identical shape. The inner barrel 34 is made of an arbitrary material such as rubber or synthetic resin in order to ensure the inner barrel 34 to be readily inserted into the outer barrel 35. An opening 36 of the inner barrel 34 is provided with an engaging edge 38 projecting from the peripheral edge thereof for ensuring an engagement with an opening 37 of the outer barrel 35. After removably inserting the inner barrel 34 into the outer barrel 35, a lid 39 is attached on the engaging edge 38 for integrally closing the inner and outer barrels 34, 35. Reference numeral 40 in the drawing designates a mount.

Also in this embodiment, the grinding barrel 8 may be mounted at a predetermined angle with respect to the rotating shaft 13 as shown in FIGS. 23*a*, 23*b*.

Figure 24:
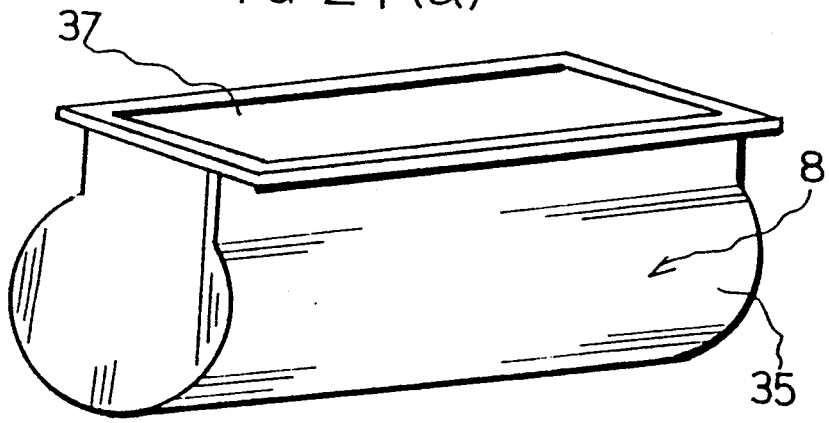
FIGS. 24*a*–24*e* are perspective views respectively illustrating a component of a grinding barrel.
Figure 24:
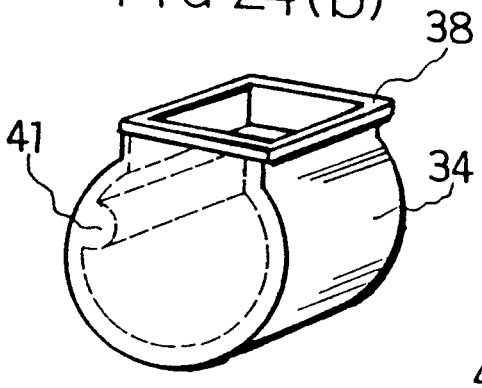
Figure 24:
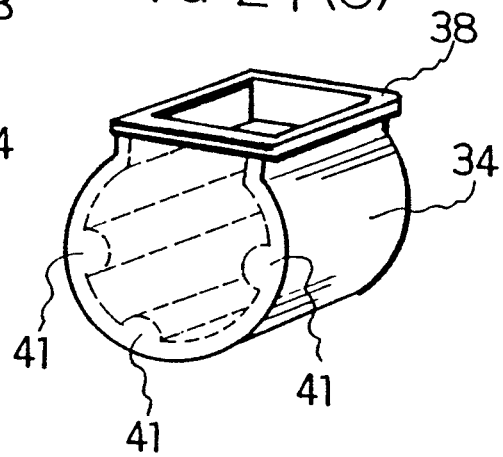
Figure 24:
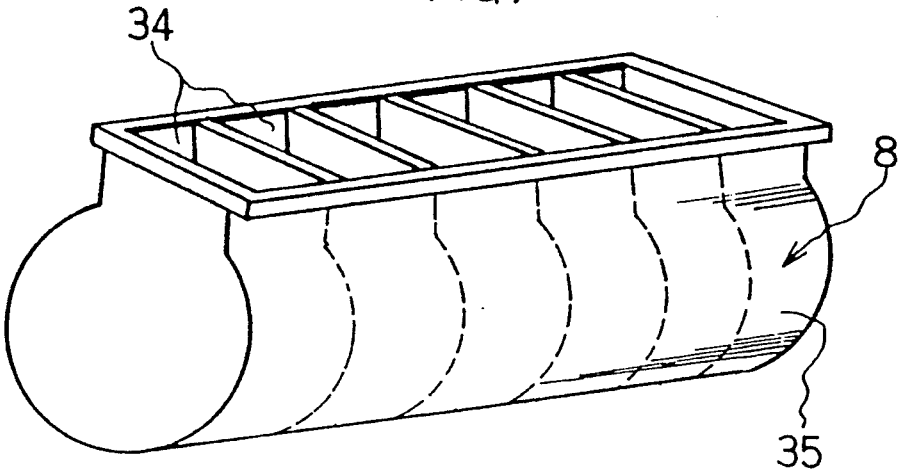

Further, the grinding barrel 8 may be separately composed of an outer barrel 35 and an inner barrel 34 as shown in FIG. 24, which facilitates accesses to ground objects accommodated in the grinding barrel 8. By previously providing a plurality of inner barrels 34, the grinding barrel 8 can be exchanged with another one in a short time. Incidentally, reference numeral 41 shown in FIGS. 24*b*, 24*c* designates ribs protrusively formed on the inner wall of the inner barrel 34 for improving the agitating effect of the grinding material and the objects to be ground when the grinding barrel 8 is rotated.

Figure 24E:
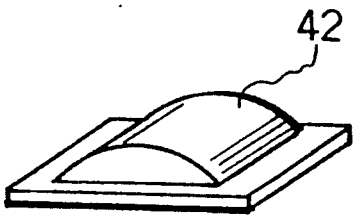

A lid 42 shown in FIG. 24*e* is used for tightly closing each of the inner barrels 34.

Figure 25:
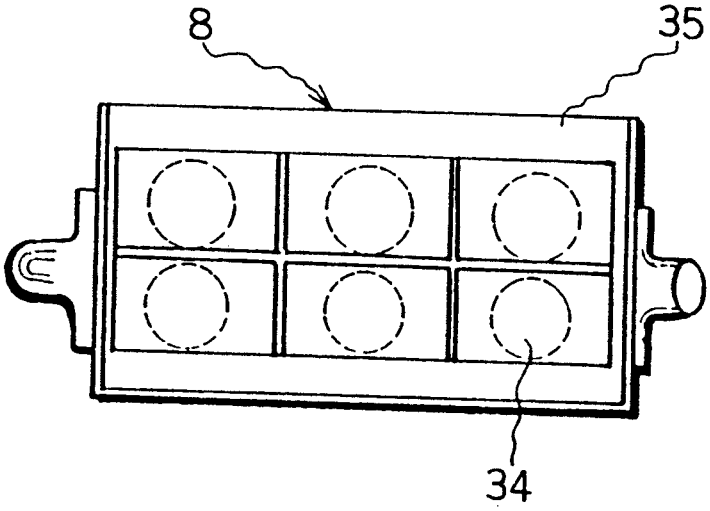
FIG. 25 is a lateral view of a grinding barrel.

A further embodiment of the grinding barrel 8 shown in FIG. 25 has an outer barrel 35 divided into a plurality of sub-chambers in two columns and inner barrels 34 respectively accommodated in the sub chambers with lids 42 (see FIG. 24*e*) placed on the respective sub-chambers. The inner barrel 34 is not necessarily provided with partition walls, and the lid 34 may be of any shape as long as it can tightly close the opening of the inner barrel 34. The inner barrel 34 has a cross-sectional shape substantially identical to that of the outer barrel 35 so as to facilitate the insertion into and removal from the outer barrel 35 and is made of a material such as rubber or polyurethan which is readily formed in arbitrary shapes. The inner barrel 34, since made of such elastic and flexible material, serves as a shock absorbing cushion for contents and promotes grinding. This grinding barrel 8 also facilitates the exchange of each of the inner barrels 34 accommodated in the divided outer barrel.35. The inner barrel 34 is provided with an engaging edge 38 for a correct accommodation in the outer barrel 35. Objects enclosed in the respective inner barrels 34 are ground by rotating the outer barrel 35.

Figure 26:
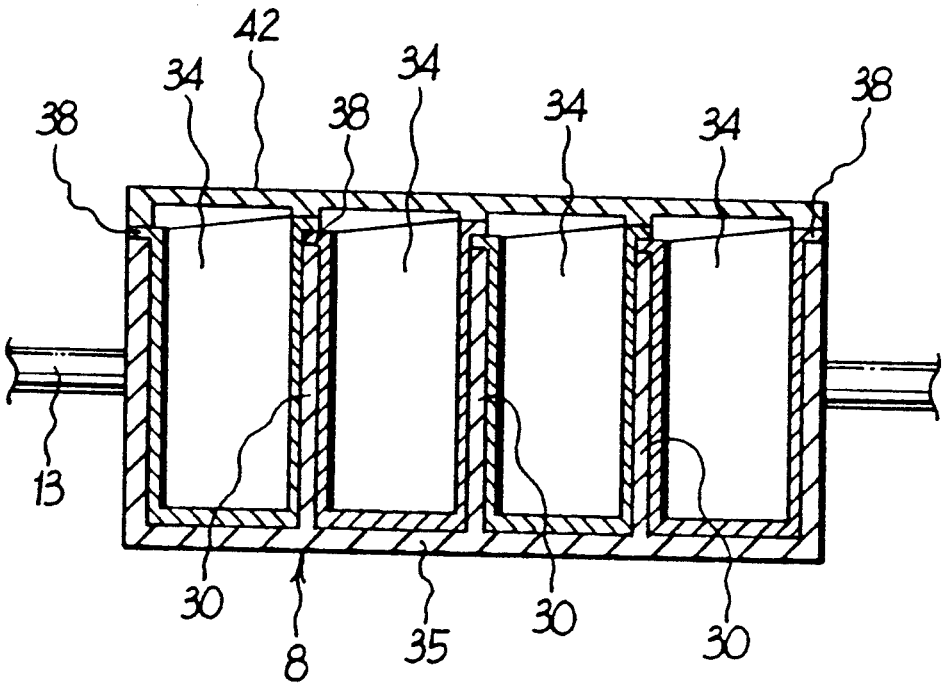
FIGS. 26 is a cross-sectional view of a grinding barrel.
Figure 27A:
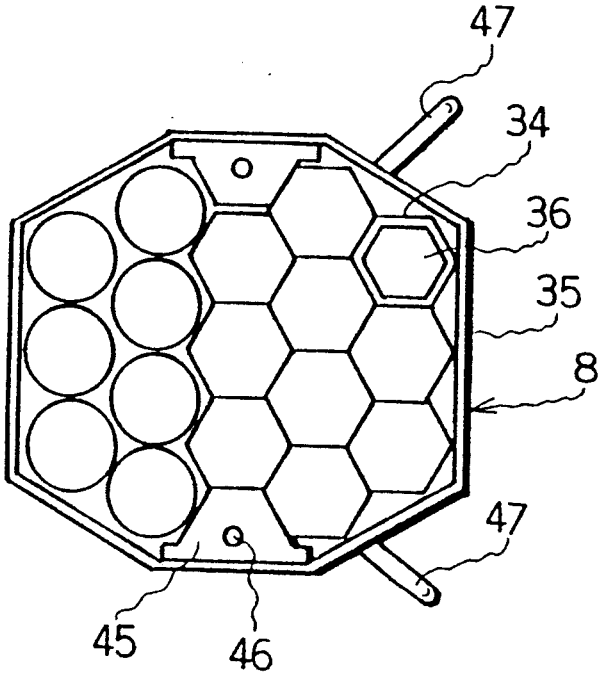
FIGS. 27*a* and 27*b* are plan views illustrating components of a grinding barrel.
Figure 27B:
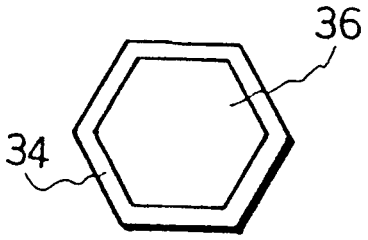
Figure 27C:
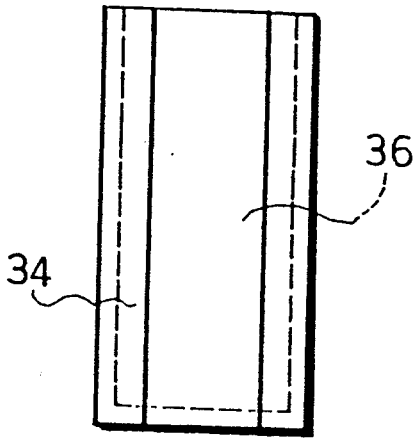
FIGS. 27*c* and 27*d* are lateral views of the components shown in FIGS. 27*a*, 27*b*, respectively.
Figure 27D:
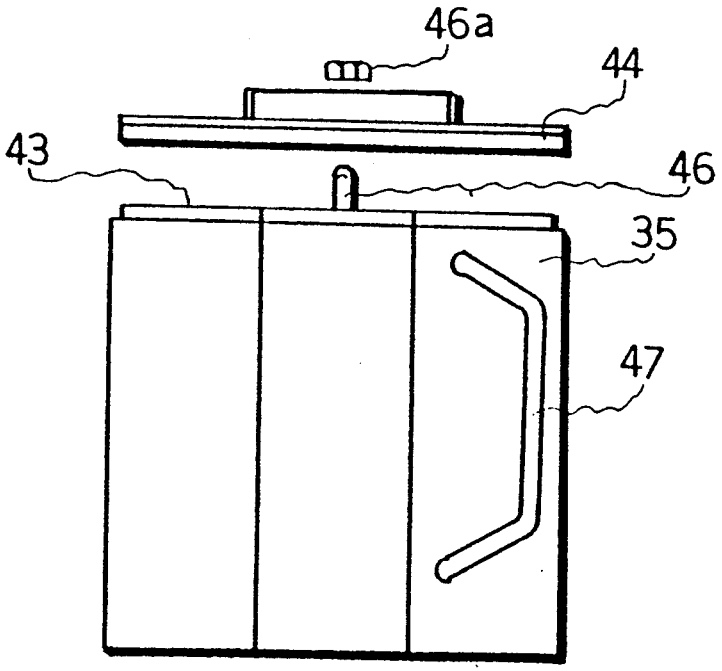

A grinding barrel 8 shown in FIG. 26 has an outer barrel 35 appropriately divided by partition walls 30 and inner barrels 34 each accommodated in a sub-chamber of thus divided outer barrel 35 with a lid 42 attached thereon.

In a grinding barrel 8 shown in FIG. 27, after inner barrels 34 are separately accommodated in an outer barrel 35, an opening of the outer barrel 35 is closed by a lid 43, and a fixing plate 44 is engaged with protrusions 46 formed on an edge portions 45 of the opening of the outer barrel 35 and fastened by a nut 46*a* together with the lid 43 disposed therebelow. The inner barrels 34, if previously formed in a hexagonal or circular shape, can be accommodated in the outer barrel 35 without producing swinging motions. Reference numeral 47 in FIGS. 27*a*, 27*d* designates a handle.

Figure 28A:
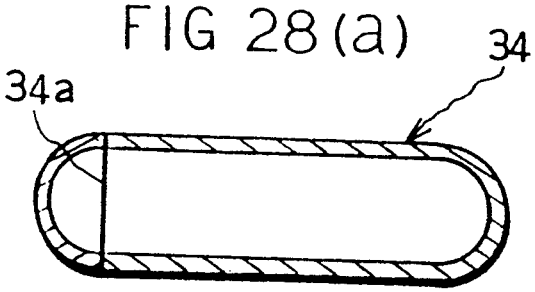
FIGS. 28*a*–28*d* are cross-sectional views respectively illustrating a grinding barrel.
Figure 28B:
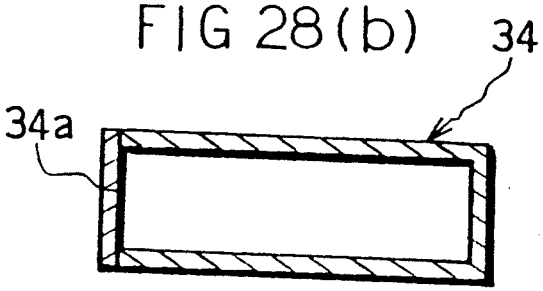
Figure 28C:
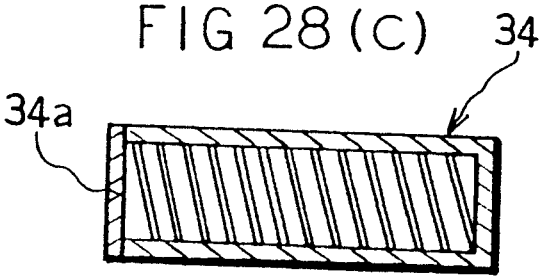
Figure 28D:
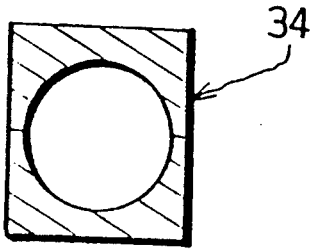

FIGS. 28*a*, 28*b*, 28*c* illustrates possible shapes of the inner barrel 34 which is provided with an opening 34*a* at one end portion thereof. FIG. 28*d* shows one having the inside formed in a spherical shape.

Figure 29:
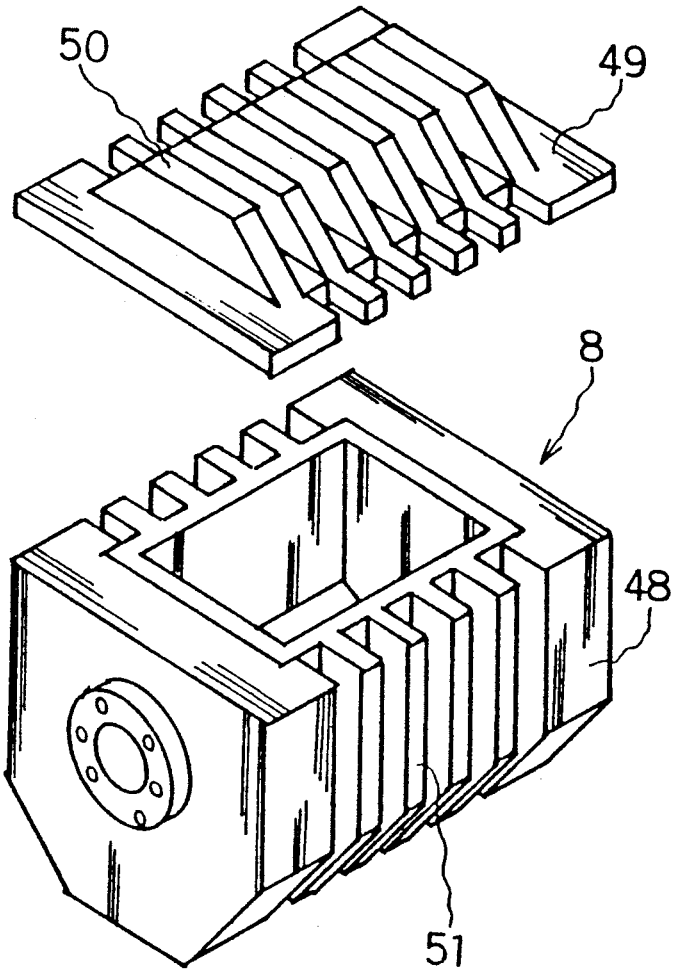
FIG. 29 is a perspective view of a finned grinding barrel.

A grinding barrel 8 shown in FIG. 29 has cooling fins 50, 51 formed on the outer surface of an outer barrel 48 and the lid 49 for a long-time grinding operation or for grinding heavy objects. The cooling fins 50, 51 are cooled by surrounding air agitated by the rotation of the grinding barrel 8, whereby a heat produced in the grinding barrel 8 is irradiated to prevent the grinding barrel 8 from being heated.

Figure 30:
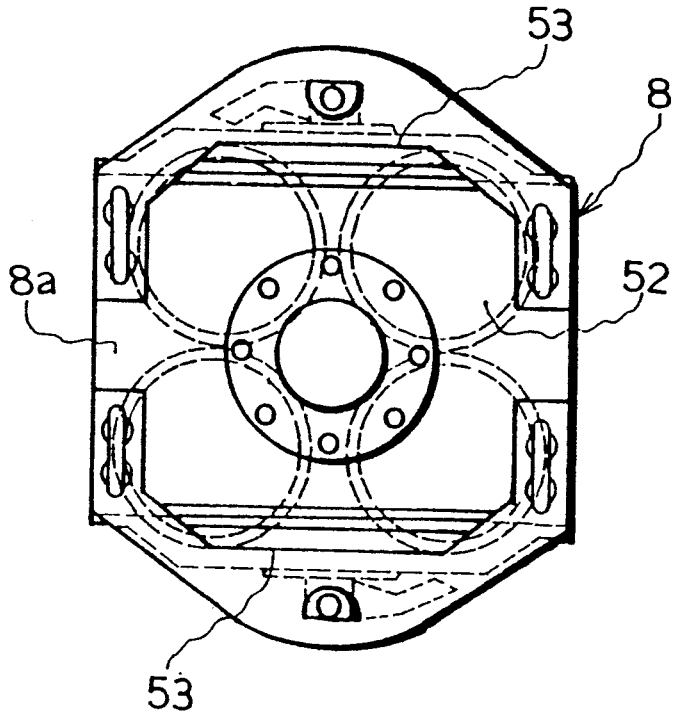
FIG. 30*a* is a lateral view of a grinding barrel.
FIG. 30*b* is a perspective view of a barrel body shown in FIG. 30*a;*
Figure 30:
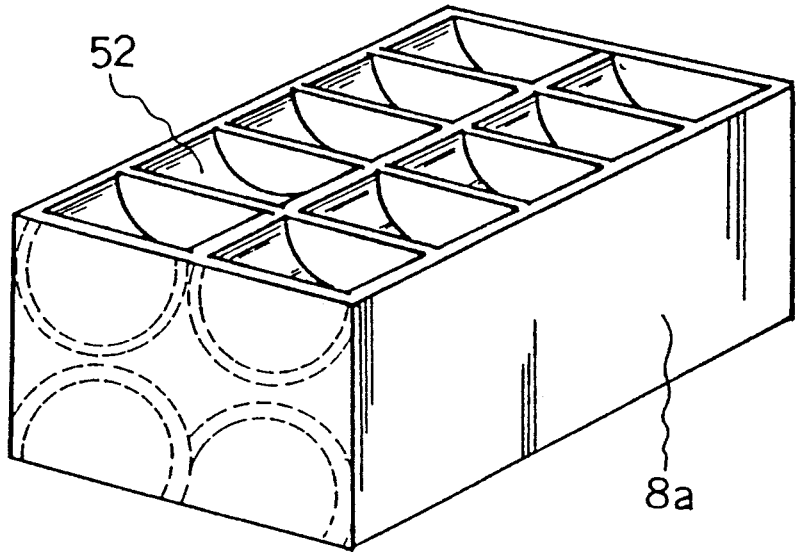

In a further embodiment shown in FIGS. 30*a*, 30*b*, it is supposed that the appearance and the cross-section of the grinding barrel 8 is arbitrary, and a plurality of chambers in an arbitrary shape, for example, rectangle, ellipse, circle or the like are formed in the grinding barrel 8. FIGS. 30*a*, 30*b* show, as an example, that a polygonal, for example, rectangular barrel body 8*a* is divided to form a multitude of sub-chambers 52 as shown in FIG. 30*b*, each of which is provided with a lid 53. This construction permits individually grinding objects, whereby bruises, caused by collisions, will not be produced on the surface of the ground objects, and accordingly a fine and high-quality grinding can be achieved. It is also possible to accommodate different kinds of objects to be ground in the sub-chambers 52.

Figure 31:
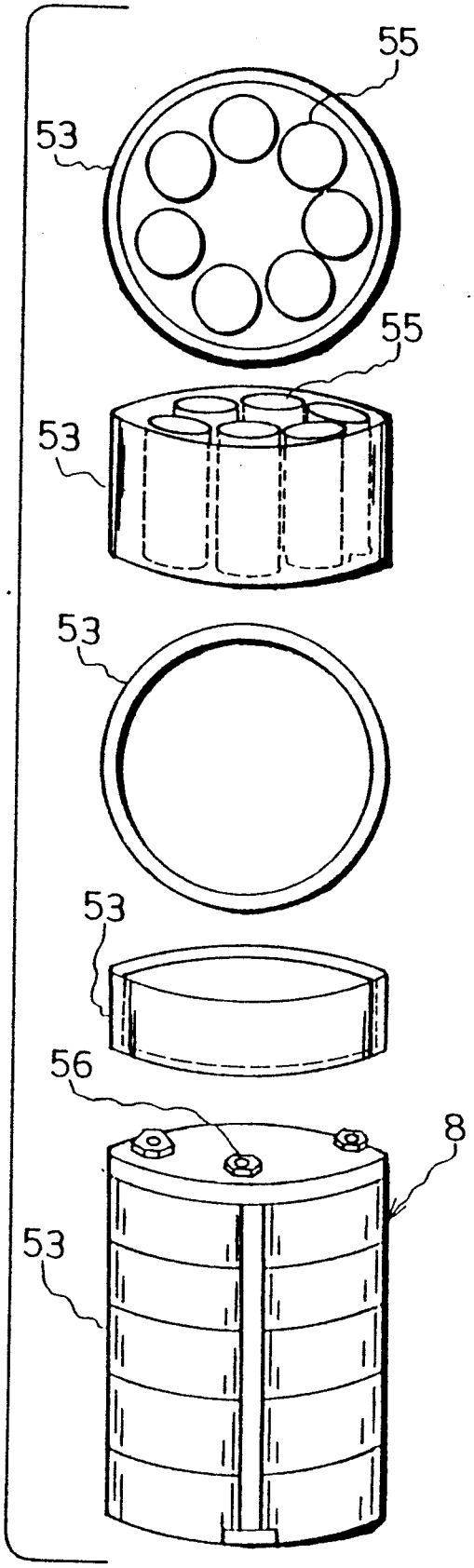
FIGS. 31 and 32 are diagrams respectively illustrating how to assemble a grinding barrel.
Figure 32:
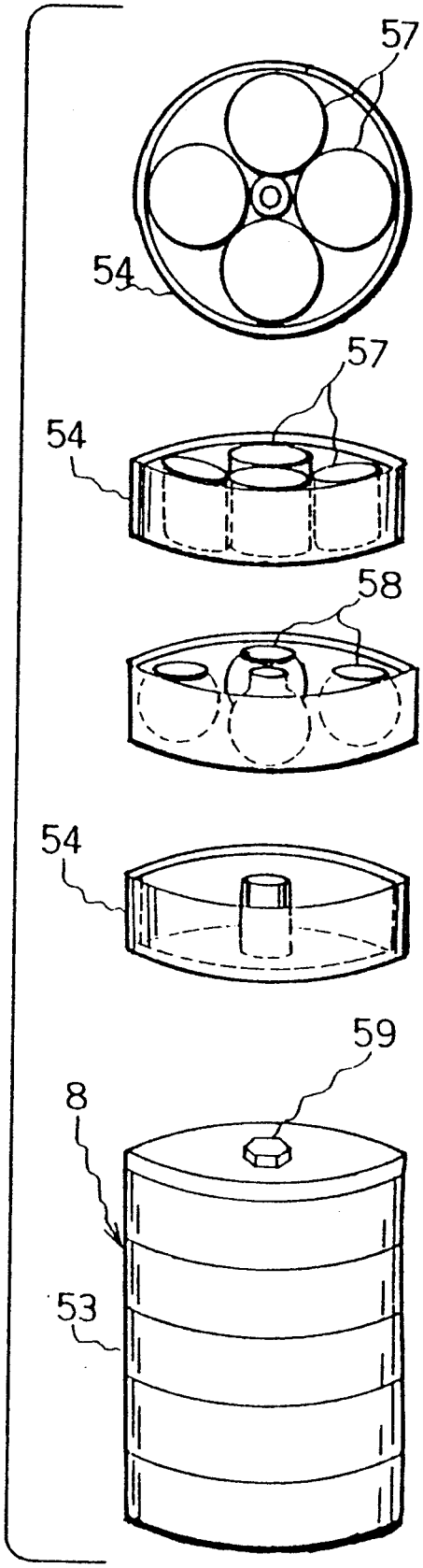

The grinding barrel 8 of the present invention may be composed of a plurality of stacked cylindrical barrels 53, 54, as shown in FIGS. 31, 32. FIG. 31 illustrates that a multitude of small cylindrical barrels 55, serving as the sub-chambers, are arranged in a cylindrical barrel 53, and a plurality of the cylindrical barrel 53 are stacked and fastened by fastening bolts 56. FIG. 32 illustrates that a multitude of small cylindrical barrels 57 or spherical barrels 58, serving as the sub-chambers, are arranged in a cylindrical barrel 54, and a plurality of the cylindrical barrels 54 are stacked and fastened by a fastening bolt penetrating the center of the cylindrical barrels 54.

Further, the grinding barrel 8, as shown in FIG. 33, may have chambers, each of which is made up of a hemispherical half barrel 61*a* having a threaded portion and another hemispherical half barrel 61*b* corresponding to the half barrel 61*a* which are engaged with each other by the threaded portions to form an internal spherical chamber 63. FIG. 33 illustrates a two-coupled barrel composed of two of the integrated grinding barrels 8.

A yet further embodiment of the grinding barrel 8 as shown in FIG. 34 comprises a plurality of long cylindrical grinding barrel bodies 64 having one end 64*a* in a hemispherical shape and the other end covered with a hemispherical lid 64*b*. With this long cylindrical type of the grinding barrel 8, it is possible to enclose a large number of objects to be ground therein at a time as well as provide a fine grinding for elongated objects which are susceptible to deformation, flexure or the like without such damages. Incidentally, FIG. 35 illustrates a grinding barrel 8 having both ends formed of flat plates 65.

I claim:

1. Apparatus for grinding or polishing particulate materials comprising a frame journalled about a central longitudinal axis, at least one grinding barrel each said grinding barrel being rotatably located within a supporting drum journalled on said frame for rotation in clockwise and counterclockwise directions about a second axis radially spaced from said central axis and drive means for independently rotating said frame and each of said drums respectively, including means for selectively changing the direction of rotation of selected ones of said frame and said drums.

2. The apparatus according to claim 1 wherein said means for selectively changing the direction of rotation of said frame and said drums is arranged so that said grinding barrels are rotated inductions opposite to that of said frame.

3. The apparatus according to claim 1 wherein said means for selectively changing the direction of rotation of said frame and said drums is arranged so that when said frame is rotated said grinding barrels alternate in rotation identical to and opposite to the direction of said frame.

4. The apparatus according to claim 1, wherein the grinding barrel and the supporting drum are coaxial.

5. The apparatus according to claim 1, wherein the axis of the supporting drum is eccentric to the axis of said grinding barrel.

6. The apparatus according to claim 1, wherein said means for driving said frame and said grinding barrels includes means for intermittent operation.

7. The apparatus according to claim 1, including means for counterbalancing the weight of the grinding barrels in operation.

8. The apparatus according to claim 7, wherein said counterbalancing means is a fly wheel attached to said drive means.

9. The apparatus according to claim 7, wherein said counterbalancing means is a balancing weight which is attached to said grinding barrel.

10. The apparatus according to claim 7, wherein said counterbalancing means is attached to said supporting drive.

11. The apparatus according to claim 9, including a fly wheel attached to said drive means.

12. The apparatus according to claim 1, wherein said grinding barrel has an internal chamber divided into a plurality of subchambers.

13. The apparatus according to claim 12, wherein said subchambers extend parallel to each other.

* * * * *